US009233041B2

(12) United States Patent
Iheoma

(10) Patent No.: US 9,233,041 B2
(45) Date of Patent: Jan. 12, 2016

(54) COMPACT AND PORTABLE GYNECOLOGICAL EXAM DEVICE

(71) Applicant: Ngozi A Iheoma, Washington, DC (US)

(72) Inventor: Ngozi A Iheoma, Washington, DC (US)

( * ) Notice: Subject to any disclaimer, the term of this patent is extended or adjusted under 35 U.S.C. 154(b) by 190 days.

(21) Appl. No.: 13/859,782

(22) Filed: Apr. 10, 2013

(65) Prior Publication Data

US 2013/0318717 A1 Dec. 5, 2013

Related U.S. Application Data

(60) Provisional application No. 61/689,273, filed on Jun. 1, 2012, provisional application No. 61/743,811, filed on Sep. 12, 2012.

(51) Int. Cl.

| | |
|---|---|
| ***A47B 71/00*** | (2006.01) |
| ***A61G 13/00*** | (2006.01) |
| ***A61G 13/08*** | (2006.01) |
| ***A61G 13/12*** | (2006.01) |

(52) U.S. Cl.

CPC ..... *A61G 13/00* (2013.01); *A61G 13/0009* (2013.01); *A61G 13/08* (2013.01); *A61G 13/1285* (2013.01)

(58) Field of Classification Search

CPC ..... A61G 13/00; A61G 13/009; A61G 13/08; A61G 13/1285; A61G 13/0018; A61G 13/06; A61G 13/105; A61G 13/0009; A61G 15/005

See application file for complete search history.

(56) References Cited

U.S. PATENT DOCUMENTS

| | | | | |
|---|---|---|---|---|
| 2,073,094 | A | 3/1937 | Bush | |
| 4,180,062 | A | 12/1979 | Alberti et al. | |
| 6,256,817 | B1 | 7/2001 | McGuire et al. | |
| 7,249,771 | B1 * | 7/2007 | Brennan | A47J 37/0704 280/35 |
| 2003/0088919 | A1 * | 5/2003 | Lin | A61G 13/105 5/620 |
| 2008/0052829 | A1 * | 3/2008 | De Vries | A61B 6/0442 5/601 |
| 2011/0010859 | A1 * | 1/2011 | Teeter | A61G 7/15 5/616 |
| 2011/0306901 | A1 | 12/2011 | Gilley et al. | |
| 2012/0271350 | A1 * | 10/2012 | Palmer | A61G 13/009 606/242 |
| 2013/0205503 | A1 * | 8/2013 | Rozewicz | A61G 13/105 5/620 |
| 2014/0150183 | A1 * | 6/2014 | Westra | A61G 7/002 5/617 |
| 2015/0150741 | A1 * | 6/2015 | Shi | A61G 7/1001 5/83.1 |

* cited by examiner

*Primary Examiner* — David E Sosnowski

(74) *Attorney, Agent, or Firm* — WPAT, PC; Justin King

(57) ABSTRACT

A compact, lightweight, and sturdy gynecological exam device which can be placed on a bed or other appropriate surfaces for healthcare practitioners to perform examinations. This gynecological exam device is designed to be folded into a compact "box-like" design for easy storage or transportation. When folded, this gynecological exam device is compact enough to fit into a luggage, preferably a standard carry-on luggage with wheels for air travel to remote areas or in-home services. This gynecological exam device has folding and sliding panels, adjustable footrests/stirrups, and adjustable headrest built into various sections of the exam table. These panels can be unfolded or slid into wider sections to accommodate patients of different sizes, heights, and weights. Further, some of these panels are to be used to ensure stability when placed on a soft surface, such as, a mattress, for safety reasons. This gynecological exam device has an adjustable back support for tilting the angle of the top section, and height adjusting mechanism to adjust the height of the lower section to ensure proper positioning of the patient for a safe, comfortable and accurate examination. This gynecological exam device can be laid flat as an exam bed or erected as an exam chair.

17 Claims, 5 Drawing Sheets

COMPACT AND PORTABLE GYNECOLOGICAL EXAM DEVICE

CROSS-REFERENCE TO RELATED APPLICATIONS

This application claims the benefit of U.S. Provisional Applications No. 61/689,273, filed on Jun. 1, 2012, and 61/743,811, filed on Sep. 12, 2012.

TECHNICAL FIELD

The present invention relates to a compact, portable gynecological exam device which can be easily unfolded or erected into an examination bed or chair for gynecological examinations, such as, pelvic and antenatal exams for women, either in-home or at off-site locations. It is designed to be collapsible into a compact size for easy storage and transportation, for example, in a standard size carry-on luggage for air travel.

BACKGROUND OF THE INVENTION

Gynecological examination, including a pelvic exam, is an important part of preventive healthcare for all adult women. A pelvic exam is a complete physical examination of a woman's pelvic organs by a health professional, usually an OB/GYN doctor, midwife or a nurse practitioner. A pelvic exam helps a health professional evaluate the size and position of the vagina, cervix, uterus, and ovaries, to detect certain cancers in their early stages, infections, sexually transmitted infections (STIs), reproductive system problems or collect evidence in cases of suspected sexual assault.

Another benefit of a regular pelvic examination is to maintain maternal health for preventing complications. However, in urban and rural settings within under-developed countries, poor traveling conditions, lack of resources, lack of education, and economic limitations make it extremely difficult for women to receive proper preventive gynecological healthcare and antenatal care during a pregnancy. According to The World Factbook published by the Central Intelligence Agency, maternal mortality rate (MMR) for the year 2010 in Chad was 1,100 deaths per 100,000 live births and 890 deaths per 100,000 live births in Central African Republic. Many of these deaths could be prevented by regular gynecological check-ups, including pelvic examinations.

In the past, most of these gynecological examinations are performed in hospitals or clinics. Gynecological exam beds or chairs utilized in these hospitals or clinics are usually heavy and bulky examination tables that are not meant to be transported frequently. In most cases, these gynecological exam beds or chairs are custom-built for that particular purpose. However, there is a growing need for these gynecological examinations to be done off-site, outside of the hospital or clinics facilities, in-home or in remote areas, due to the growing population of senior citizens in the United States and around the world. At the same time, local in-home healthcare and assisted living for seniors are growing in the United States by leaps and bounds, increasing the demand for off-site gynecological examinations.

Medical healthcare practitioners performing in-home services are constantly faced with the challenge of not being able to provide certain medical examinations to their patients even though they are well qualified to do so. One such examination is a pelvic examination. A patient's body needs to be arranged in a precise position for accuracy and safety during such pelvic examination. Patients should be able to abduct their legs independently, move around on top of the exam bed or chair and follow instructions without difficulty during their pelvic exams. Further, patients receiving medical in-home services are often disabled individuals with medical and/or physical conditions that limit their ability to utilize a standard gynecological exam bed or chair found in OB/GYN facilities and outpatient clinics. Without the precise adjustments of a well-designed gynecological exam bed or chair, healthcare professionals practicing in-home services have to often turn down patient's request for a pelvic exam or other gynecological examinations.

As mentioned before, in many parts of the world, especially some under-developed countries in Africa, healthcare system infrastructure is extremely poor. Many villages have no clinic or hospital facility at all. Patients have to travel long distance to villages that have such facilities for their healthcare needs. Many patients are discouraged to travel such long distance to those facilities, therefore, being deprived from necessary professional healthcare as a result. Volunteers from around the world, for example, "Doctors Without Borders," are trying their best to solve this problem by traveling to these local villages without healthcare facilities, bringing professional healthcare services to these patients directly. Such healthcare services include pelvic and antenatal exams for women who cannot travel far distance to their clinics which are often hours away. In those remote environments, healthcare practitioners most likely will have to provide their own gynecological exam bed or chair in order to perform such pelvic and antenatal examinations.

There is a need for a compact, lightweight and sturdy gynecological exam device that can be placed on a bed or other appropriate surfaces in order for the healthcare practitioner to perform a proper examination on a patient. Yet, such gynecological exam device has to be compact enough to fit into a luggage for easy transportation, such as, air travel to remote areas.

A lightweight portable pelvic exam device is disclosed in a published U.S. Patent Application No. US 2011/0306901 A1. This pelvic exam device is designed as a bed that is not collapsible or foldable for easy storage and transportation. Further, the elevation height of the bed at the pelvic end is fixed, not adjustable to accommodate different size patients.

Another adjustable obstetrical chair is disclosed in U.S. Pat. No. 2,073,094. This chair is designed to be foldable into a large size case for transportation. Once erected, there is no adjustment on the inclination of the seat back or the height of the chair. It cannot be laid flat as a table, therefore, not suitable to be placed on a patient's bed.

U.S. Pat. No. 6,256,817 discloses another collapsible gynecological exam chair, similar to the chair disclosed in U.S. Pat. No. 2,073,094, not to be laid flat on the patient's bed. Both of these patents fail to serve patients who have limited mobility and/or paralysis, such as, problem standing, sitting, walking and bending.

U.S. Pat. No. 4,180,062 discloses a portable childbirth chair. This chair has foldable leg support panels, adjustable backrest and headrest. However, this invention is also designed as a chair which is not suitable to be placed on a flat bed. Further, this invention is specifically designed for childbirth, without any adjustment for pelvic elevation.

None of the prior art devices described above meets the objectives of the present invention, which are:

i. lightweight,
ii. easy folding and unfolding,
iii. adjustable and strong enough to accommodate patient of different sizes, shapes and weights, iv. compact enough to fit in a luggage, preferably a standard carry-on luggage for easy storage and transportation, v. can be laid flat as a bed or erected upright as a chair, and vi. expandable panels at the base for stability by distributing weight on the bed for above-average size patients.

SUMMARY OF THE INVENTION

One objective of the present invention is to design a gynecological exam device that is capable of performing examinations, including pelvic exam, on a female in their own bed at home. For example, patients who are homebound and bedbound due to limited mobility.

Another objective of the present invention is to design a gynecological exam device that can also be used in a clinic or doctor's office that does not perform gynecological examinations routinely, therefore, does not have a dedicated gynecological exam bed or chair.

Another objective of the present invention is to design a lightweight, portable gynecological exam device that can be easily carried by a single person, for example, a healthcare practitioner performing in-home services.

Another objective of the present invention is to design a compact gynecological exam device that can be easily erected to perform examinations, and collapsed for storage.

Another objective of the present invention is to design a durable and adjustable gynecological exam device that can accommodate patients of different sizes, shapes and weights.

Yet another objective of the present invention is to design a gynecological exam device which is compact and lightweight enough to be stowed away in a luggage, such as, a standard size carry-on bag or backpack for air travelers.

BRIEF DESCRIPTION OF THE DRAWINGS

The accompanying drawings, which are incorporated in and constitute a part of this specification, illustrate aspects of the invention, together with a general description of the invention given above, and the detailed description given below, serve to explain the principles and operations of the present invention.

DETAILED DESCRIPTION OF THE INVENTION

Figure 1:
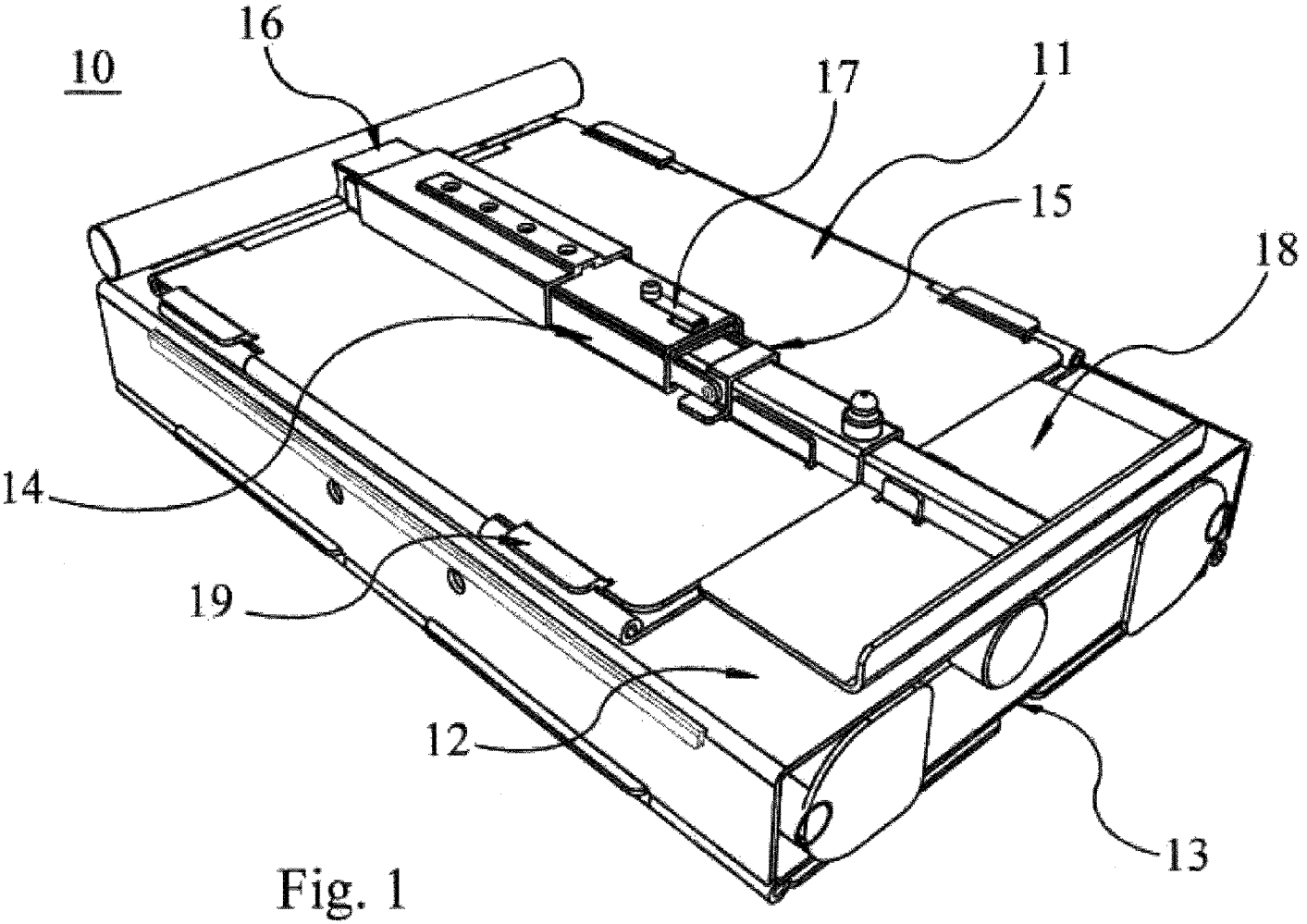
FIG. 1 is a top view of the compact gynecological exam device showing it completely folded after use and ready for transport.

In FIG. 1, a compact gynecological exam device with all the parts retracted or collapsed into a compact box-like structure is shown. Preferably, this gynecological exam device will be designed to fit into a standard size carry-on luggage or backpack with rolling wheels as used by air travelers. The gynecological exam device 10 has a rectangular top section 11 with a front surface and a back surface. A U-shaped rectangular bottom section 12 with flanges along two sides. The top section 11 is hinged to the bottom section 12 at one end without the flanges. The bottom section 12 also has a front surface and a back surface. A rectangular base section 13, having a front surface and a back surface, is fastened to the back surface of the bottom section 12. The front surface of the top section 11 will be facing the front surface of the bottom section 12 when collapsed or folded. A back support 14 is pivotally attached to the back surface of the top section 11 between the one end that is hinged and an opposite end that is not hinged by a u-shaped bracket 15. A T-shaped back support base 16 having a spring-loaded button or pin 17 is attached to the back support 14 to enable the top section 11 to be tilted at various angles when the gynecological exam device 10 is erected. A sliding headrest 18 is adjustably attached to the top section 11 at the opposite end that is not hinged. Limiting tabs 19 are formed on both sides of the top section 11 that are not hinged to the bottom section 12. Similar limiting taps 19 are also formed on the base section 13. These limiting taps 19 are used to limit the rotation of the foldable top section side panels 21 and base section side panels 23 to ensure a stable support when the gynecological exam device is fully erected.

Figure 2:
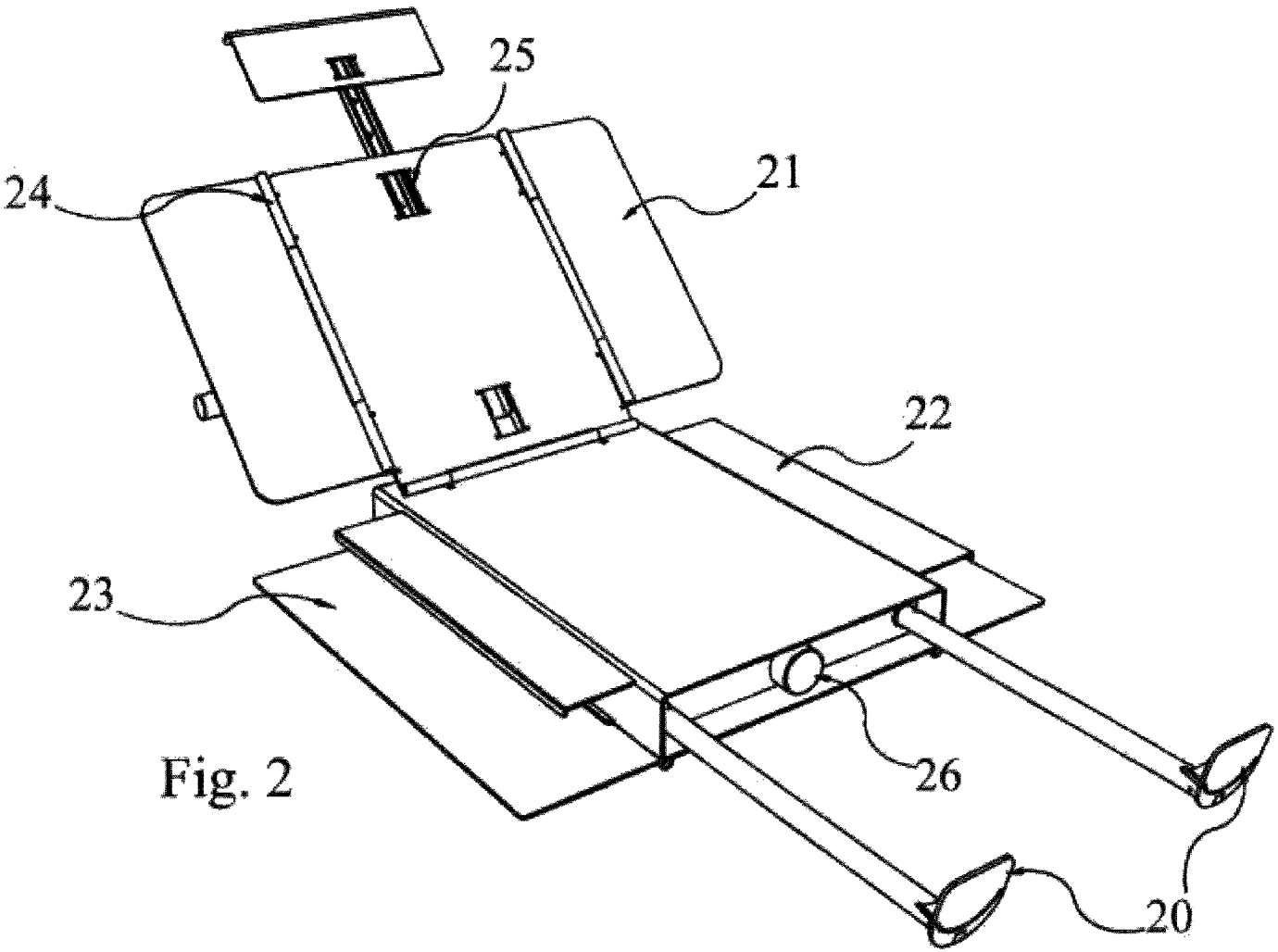
FIG. 2 is a frontal full view of the compact gynecological exam device fully erected, and with all the panels and footrests/stirrups unfolded or extended.

In FIG. 2, a frontal view of the compact gynecological exam table fully erected is shown. It shows the top section 11 is unfolded from the bottom section 12 and tilted at an angle by the back support 14. During a pelvic exam, the patient's lumbar and torso area is supported by the top section 11, and seated on top of the bottom section 12 with the legs extended and resting on the footrests/stirrups 20. The footrests/stirrups 20 are stored through the opening between the bottom section 12 and base section 13 at the opposite end that is not hinged. FIG. 2 also shows the folding top section side panels 21 are connected by hinges 24 on both left and right sides of the top section 11. Top section side panels 21 will be folded inwardly toward the front surface of the top section 11 when collapsed. Bottom section side panels 22 are stored at both left and right sides of the bottom section 12 through openings on the flanges. The bottom section side panels 22 can be slid inwardly and outwardly through the openings and stored underneath the back surface of the bottom section 12. Folding base section side panels 23 are also connected by hinges 24 to both left and right sides of the base section 13. The base section side panels 23 are folded inwardly towards the back surface of the base section 13. All these folding top side section panels 21, sliding bottom section side panels 22, and folding base section side panels 23 are utilized to accommodate patients with above-average size, weight and height to use the compact gynecological exam device 10 for gynecological examinations. The folding top section side panels 21 and sliding bottom section side panels 22 are unfolded and extended respectively to provide maximum comfort to the patient. The base section side panels 23 are in contact with the patient's own bed when unfolded, providing an expanded surface for stability by redistributing the patient's weight in order to prevent the compact gynecological exam bed or chair from collapsing or sinking into the mattress during examination. The sliding headrest 18 is extendable for a comfortable fit to accommodate patients of various heights. The footrests/stirrups 20 are adjustably attached at the end of tubular-shaped or rectangular-shaped rods which can be manually extended in and out and could be padded for maximum comfort when the patient is in a dorsal lithotomy or supine position. After use, the footrests/stirrups 20 can be folded and the rods are pushed back into the space between the bottom section 12 and base section 13 for storage. It is to be understood that the gynecological exam device of the present invention is designed to be fully functional without having any or all of the foldable and slidable side panels being unfolded or extended. These side panels are only needed when examination is performed on an above-average size patient for maximizing comfort and safety. Two cut-outs 25 are formed on the top section 11 for the headrest 18 alignment. Further, a bottom section 12 height adjusting knob 26 is located in the opening between the bottom section 12 and base section 13 mentioned.

Figure 3:
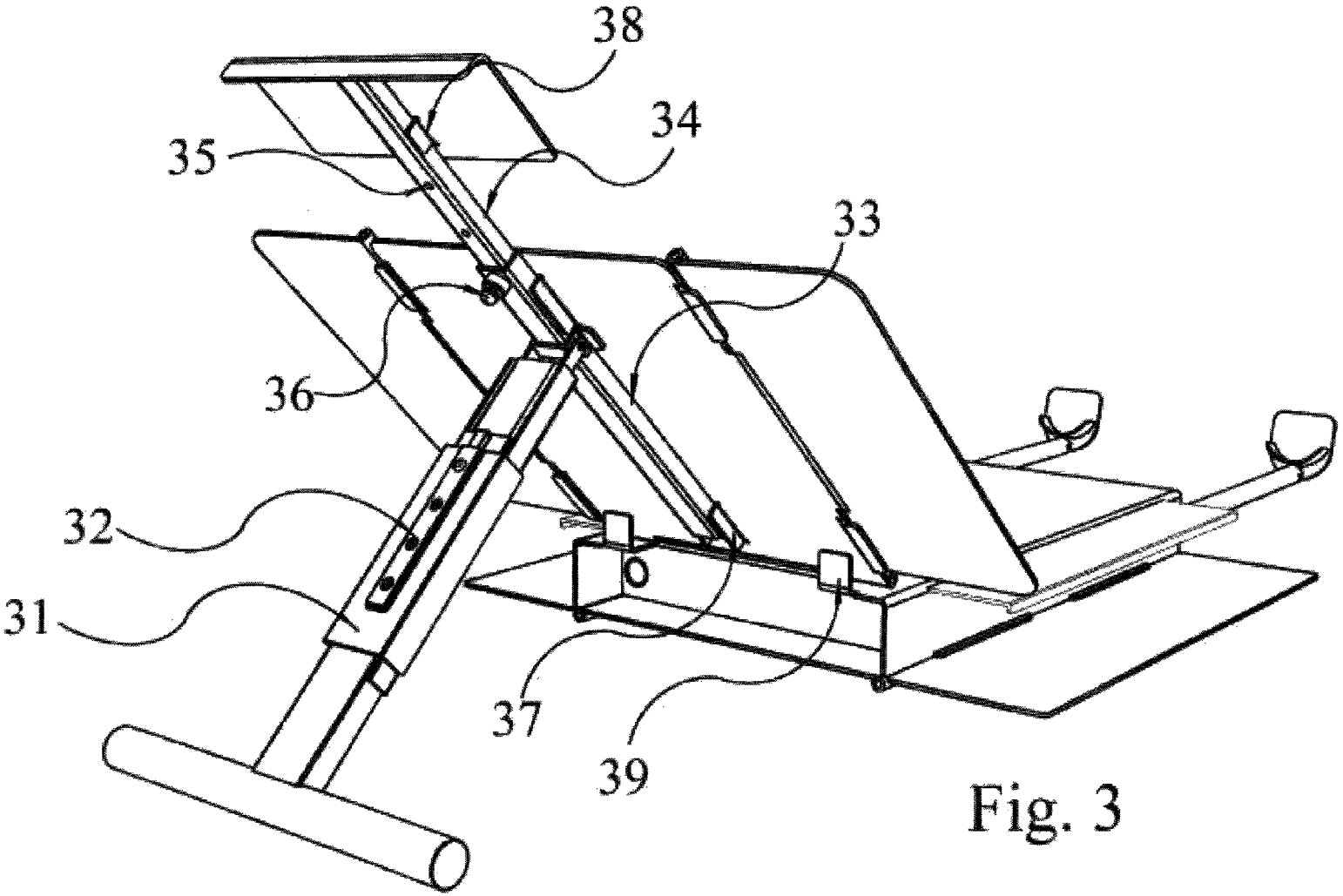
FIG. 3 is a back view showing the back support tilted and extended.

In FIG. 3, a rear view of the gynecological exam device 10 is shown, showing the arrangement of the tilted back support 14 and the top section 11. The top section 11 is supported by the back support 14 on the back side of the top portion 11 of the gynecological exam device 10. The back support 14 is constructed in a u-shaped channel having an adjustment bracket 31 also constructed in a u-shaped channel inversely connected to each other to form an enclosed channel. The adjustment bracket 31 having plurality of eyelets 32 designed to accommodate the spring-loaded button or pin 17 of the T-shaped back support base 16. When the gynecological exam device 10 is being erected, the back support 14 is pulled away from the back surface of the top section 11 with the horizontal section of the T-shaped back support base 16 resting on the mattress when used with a bed. The tilt angle of the top section 11 is being adjusted by sliding the T-shaped back support base 16 through the enclosed channel and locked in position by the spring-loaded button 17 and eyelets 32 arrangement. The horizontal section of the T-shaped back support base 16 is shown to be tubular. However, any cylindrical or polygonal shaped horizontal section can also be applicable. The back support 14 can be tilted manually up to a maximum tilt angle according to the patient's comfort and stability of the exam device by adjusting the length of the back support base 16. A headrest support channel 33 is connected to the back surface of the top section 11 by the u-shaped bracket 15. The headrest 18 has a headrest support post 34 with eyelets 35 inserted into the headrest support channel 33. The headrest support channel 33 also has a nut-and-bolt locking mechanism 36 to be inserted into the eyelets 35 of the headrest support bar 34 for height adjustments. Obviously, any appropriate locking mechanism other than the nut-and-bolt locking mechanism 36 can be used. For example, it could be designed with any conventional locking mechanism, such as, wing-nut and screw, rotating knob, spring-loaded pin and eyelets, and frictional discs, etc. Two headrest support channel guiding tabs 37 are formed by cut-outs 25 on the back surface of the top section 11 for guiding the headrest support channel securely in place. A similar headrest support post guiding tab 38 is formed by cut-out 25 from the headrest 18. End tabs 39 are formed at the hinged end of the bottom section 12 to restrict the movement of the T-shaped back support base 16 when the gynecological exam device is collapsed for storage or transportation.

Figure 4:
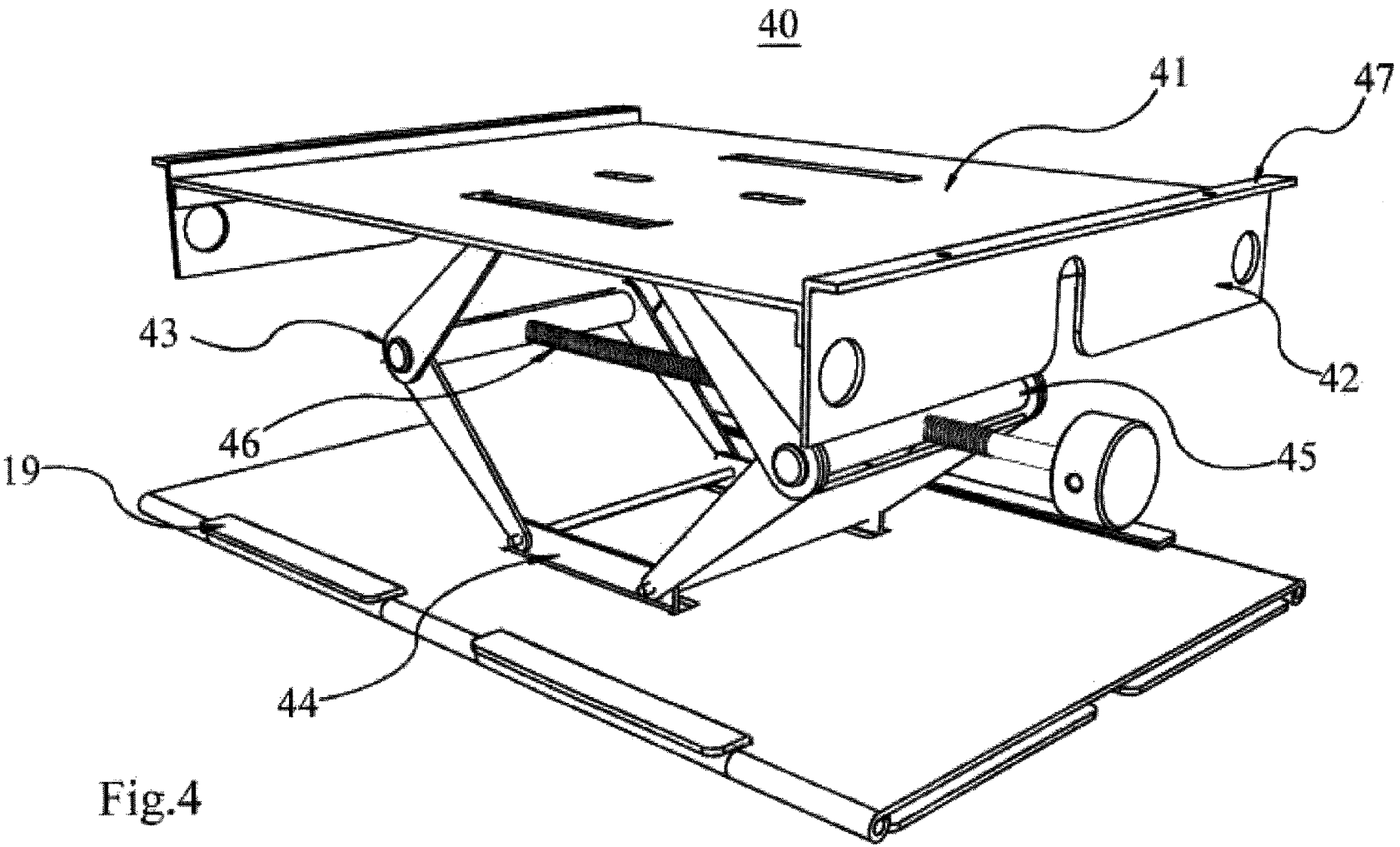
FIG. 4 is a perspective view of the lifting mechanism and base section attachment.

In FIG. 4, a perspective view of the arrangement of the lifting mechanism 40 and the base section 13 is shown. A simple manual scissor jack type arrangement is used for the lifting mechanism 40. The lifting mechanism includes a platform 41 having two platform flanges 42 connected to 2 opposite sides of the platform 41. There are four scissor arms 43, each having a pair of blades with a base and a tip. Each pair of blades is connected at their bases. A pair of lift brackets 44 is connected to the front surface of the base section 13 in parallel. Another pair of lift brackets 44 is connected to platform 41 in parallel. The tips of the blades of the four scissor arms 43 are attached to both ends of the two pairs of lift brackets 44 connected to the base section 13 and platform 41 respectively. Two cross members 45 are connected to the bases of the scissor arms 43 to provide pivotal movements. The height adjusting knob 26 has a long screw 46 threaded through the center of the cross members 45. Each platform flange 42 has a lip 47 for providing connection to the bottom section 12. The two platform flanges 42 are connected to the platform 41 at a slight elevation above the top surface of the platform 41 so as to provide a space to store the bottom section side panels 22. The height of the bottom section 12 is raised by the platform 41 when the adjusting knob 26 is turned to expand or contract the scissor arms 43. The height of the bottom section 12 could be raised up to six inches or more depending on the length of the scissor arms 43. This elevation is necessary according to particular examination performed so as to maximize the patient's comfort and safety. The elevation is controlled manually as disclosed is by a height adjustment knob 26 of the lifting mechanism 40. Alternatively, the expansion and contraction of the scissor arms 43 can be done by hydraulic, pneumatic or electrical means, as is apparent to an artisan.

Figure 5:
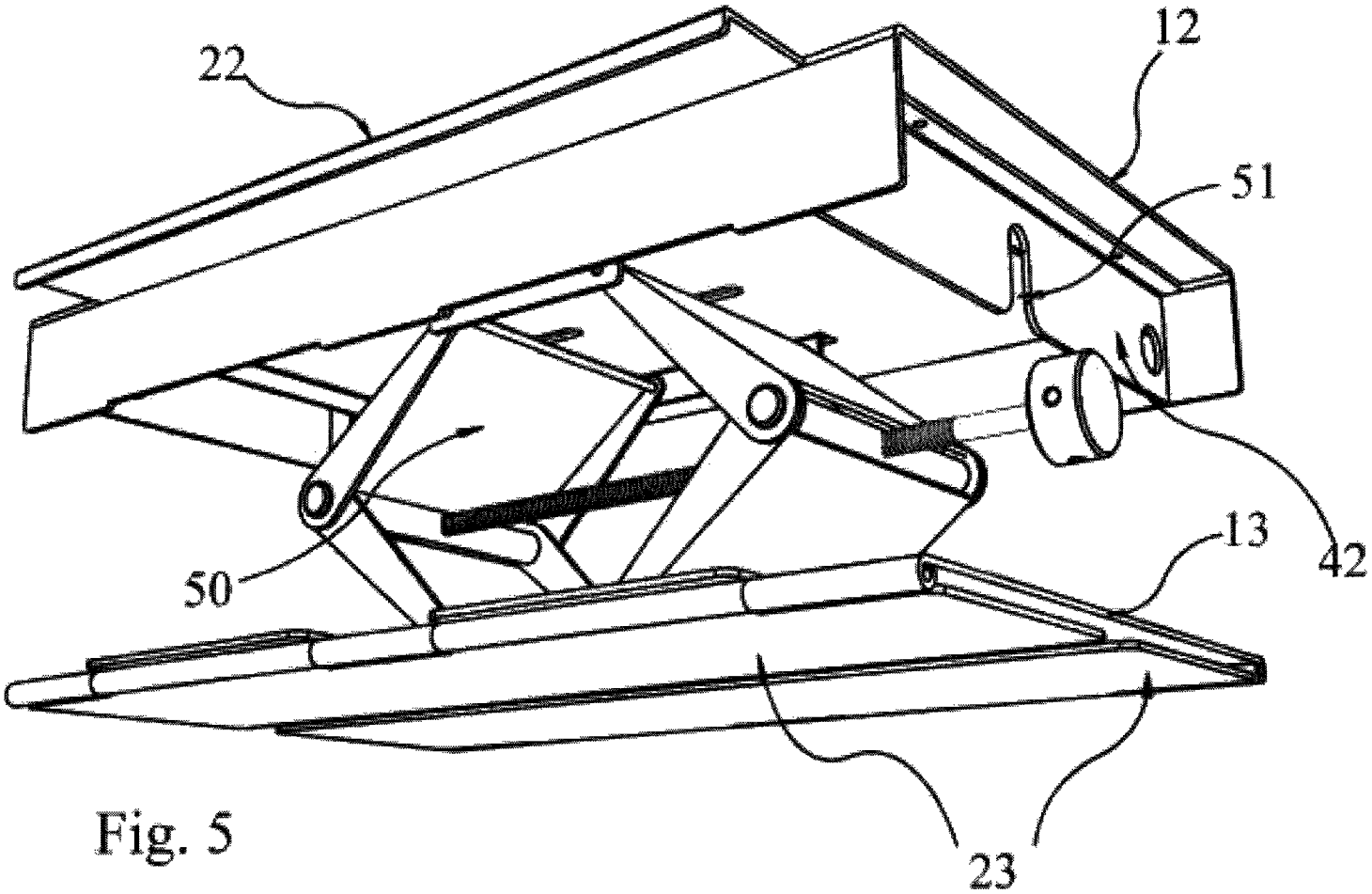
FIG. 5 is a perspective view of the lifting mechanism and bottom section attachment.

In FIG. 5, a perspective view of the arrangement of the lifting mechanism 40 and the bottom section 12 is shown. The bottom section 12 is supported by the lips 47 of the platform flanges 42. Bottom section side panels 22 are recessed into the space created by the top surface of the platform 41 and the back surface of the bottom section 12. The opposite platform flanges 42 are slightly recessed at the one end and the opposite end of the bottom section 12, and perpendicularly mounted to the flanges of the bottom section 12. When the bottom section 12 is lowered, the platform flanges 42 will conceal the lifting mechanism, exposing only the adjusting knob 26 in the recessed space. This arrangement will give a clean, box-like package without the adjusting knob 26 protruding when the gynecological exam device is folded for storage or transportation. As seen in FIG. 5, supporting plate 50 can be inserted between the scissor arms 43 to provide further strength to the platform 41 if needed. A notch 51 is formed on one of the platform flanges 42 to accommodate the long screw 46 when the platform 41 is completely lowered.

In practice, healthcare practitioners are constantly faced with the challenge of performing gynecological examinations at a remote site other than a clinic or hospital equipped without a proper examination bed or chair. One of the most popular gynecological examinations is a pelvic exam, which requires precise positioning of the patient's lower body in order to have a comfortable, safe and accurate examination. Patients who require in-home service are usually limited in mobility, therefore, they are usually bedbound and/or homebound. In most instances, they cannot get out of bed or sit in a chair to be examined. A female patient with limited mobility of extremities and lower back would experience extreme hardship and discomfort if she had to sit in a chair or get out of her bed for a pelvic exam. The patient will have to maintain her buttock above the front end of the seat of the chair. Even in a dorsal lithotomy or supine position, this will be extremely difficult and uncomfortable for patients with physical handicaps and limited mobility in the hip, waist, and lower legs. Further, it is difficult to perform such pelvic exam at home on a regular bed without running the risk of injury to the patient, which might lead to incomplete pelvic examination, contamination and unsafe issues.

All known gynecological exam beds or chairs in a clinic or hospital are bulky and heavy, which are usually custom built and affixed to the floor primarily for the purpose of gynecological and pelvic examinations only. They cannot be easily transportable from room to room or to be used on a patient's own bed in the home. Therefore, there is a dire need for a gynecological exam device that would allow in-home or off-site patients to comfortably receive pelvic exam on their own bed without the aforementioned risks and disadvantages.

The present invention as described in detail above is such a gynecological exam device 10 which will fulfill these long awaited needs. The lightweight and portable, yet sturdy and compact, gynecological exam device detailed above is described as a bed being placed on a regular bed at home. However, the gynecological exam device 10 of the present invention is not limited to such usage. It would be obvious to one of ordinary skilled in the art to place the gynecological exam device 10 of the present invention at the edge of the bed or on top of a regular chair or any solid elevated surface, to utilize it as a gynecological examination chair. The portable gynecological exam device 10 of the present invention is designed to be compact, lightweight and collapsible into a size for easy storage and transportation. One of the design criteria of the present invention is that it has to be fitted into a luggage, preferably a standard size carry-on, when collapsed. Carry-on luggage must be small enough to fit easily into an overhead bin or beneath the seat, because luggage is not allowed on laps or in the aisles. Most airlines allow bags up to 45 linear inches in size, or measuring 9-by-14-by-22 inches. Preferably, the standard size carry-on luggage is a bag or backpack with wheels as used by air travelers. One advantage is that the compact gynecological exam device 10 does not need to have wheels attached for transportation in order to save production cost. On the other hand, if cost is of no object, wheels can be appropriately attached to the gynecological exam device 10 with either the headrest 18 or T-shaped back support base 16 extended as the handle bar for easy transportation.

As disclosed in the description above and the figures, all the side panels (21, 22 and 23) top section 11, bottom section 12, back support 14, back support base 16, headrest 18, and footrests/stirrups 20, are shown to be operating manually. However, such manual operations can be easily automated if desired, using designs that conform to current engineering and safety standards. The surfaces of the gynecological exam device 10, top and bottom sections (11 and 12) can be padded and upholstered with soft leather or other soft thin material for patient's comfort. The gynecological exam device 10 of the present invention can be constructed with any appropriate lightweight and sturdy material, such as, aluminum, steel, PVC, carbon fiber, and other composite material or the like, which will be able to accommodate patients of any size, weight and height.

While the present invention has been illustrated by a description of various aspects and features of the invention and while these aspects and features have been described in considerable detail, it is not the intention of the applicant to restrict or in any way limit the scope of the appended claims to such detail. Additional advantages and modifications will readily apparent to those skilled in the art. The invention in its broader aspects is therefore not limited to the specific details, representative apparatus and method, and illustrative examples shown and described. Accordingly, departures may be made from such details without departing from the spirit or scope of the applicant's general inventive concept.

What is claimed is:

1. A portable gynecological exam device comprising:
a top section with a front surface and a back surface;
a bottom section with a front surface and a back surface;
a base section with a front surface and a back surface;
said top section having a first end and an opposing second end, wherein said top section abuts said bottom section at said first end;
said base section is attached to said bottom section;
first and second adjustable footrest means located between a space formed by said back surface of said bottom section and said front surface of said base section at said second end;
a back support means attached to said back surface of said top section;
a headrest attached to said back support means;
height adjustment means for adjusting a height of said bottom section;
wherein:
said top section, said bottom section, and said base section are rectangular-shaped;
first and second folding panels are connected to opposite sides of said top section;
first and second sliding panels are inserted into said bottom section; and
first and second folding panels are connected to opposite sides of said base section;
wherein:
said first and second folding panels of said to section fold inwardly towards said front surface of said top section;
said first and second sliding panels of said bottom section slide inwardly beneath said back surface of said bottom section;
said first and second folding panels of said base section fold inwardly towards said back surface of said base section; and
a plurality of limiting tabs are formed on said opposite sides of said top section and said base section to limit rotation of said first and second folding panels of said top section and said base section; and
wherein said gynecological exam device has a deployed state in which it is erected into a bed or a chair and a collapsed state in which it is collapsed into a box-shape and is storable in carry-on luggage.

2. A portable gynecological exam device as recited in claim 1 wherein:
first and second flanges extending along opposing sides of said bottom section; and
wherein said front surface of said top section faces said front surface of said bottom section when the gynecological exam device is in the collapsed state.

3. A portable gynecological exam device as recited in claim 2 wherein:
said bottom section is rectangular-shaped; and
said first and second sliding panels are inserted into said bottom section along said first and second flanges.

4. A portable gynecological exam device as recited in claim 1 wherein:
said top section is rectangular-shaped; and
said first and second folding panels of said top section are connected to opposite sides of said top section extending from said first end to said other second end.

5. A portable gynecological exam device as recited in claim 1 wherein:
said base section is rectangular-shaped; and
said first and second folding panels of said base section are connected to opposite sides of said base section.

6. A portable gynecological exam device as recited in claim 1 further comprising:
a bracket attached to the back surface of said top section;
a plurality of channel guiding tabs are formed on said back surface of said top section;
said back support means is pivotally connected via a pivotal connection to said bracket; and
a headrest support channel is inserted between said plurality of channel guiding tabs and is secured by said bracket.

7. A portable gynecological exam device as recited in claim 6 further comprising:
a headrest post secured to said headrest by a plurality of post guiding tabs; and said headrest post is adjustably inserted into said headrest support channel by a locking mechanism.

8. A portable gynecological exam device as recited in claim 6 wherein:

said back support means further comprises:

a back support bracket;

a T-shaped back support base having a long post and a horizontal bar; and said long post is inserted into said back support bracket.

9. A portable gynecological exam device as recited in claim 6 wherein:

said T-shaped back support base has a spring-loaded button at one end of said long post;

said back support bracket has a plurality of eyelets on a top surface thereof; and said back support means is configured to be angled and locked in place at said pivotal connection when in use.

10. A portable gynecological exam device as recited in claim 8 further comprising:

a pair of end tabs formed on said bottom section to restrict movement of said T-shaped back support base when the gynecological exam device is in the collapsed state.

11. A portable gynecological exam device as recited in claim 8 wherein said long post is rectangular in shape; and said horizontal bar is tubular or rectangular in shape.

12. A portable gynecological exam device as recited in claim 9 wherein:

said top section can be tilted at a desired angle by sliding said spring-loaded button through said plurality of eyelets to adjust the length of said T-shaped back support base.

13. A portable gynecological exam device as recited in claim 1 wherein:

said height adjustment means further comprises:

a platform having a top surface, a bottom surface, a first end, and an opposing second end;

a plurality of scissor arms, each having a pair of blades with each blade having a base and a tip, each pair of blades being connected at their bases;

wherein the plurality of scissor arms comprises a first pair and a second pair of scissor arms;

a plurality of lift brackets, each lift bracket having two ends;

a pair of cross members, each having two ends and a broad side;

each cross members is connected at its two ends to the bases of two pairs of said plurality of scissor arms to provide pivotal movements;

a long screw attached to an adjusting knob; and said long screw is threaded through said broad sides of said pair of cross members.

14. A portable gynecological exam device as recited in claim 13 wherein:

said plurality of lift brackets comprises a first pair and a second pair of lift brackets;

a first pair of said plurality of lift brackets is connected in parallel to said front surface of said base section;

a second pair of said plurality of lift brackets is connected in parallel to said bottom surface of said platform;

said first and second pairs of said plurality of scissor arms are respectively connected to said first and second pairs of lift brackets at their two ends respectively;

the tips of said first and second pairs of scissor arms are connected to the front surface of said base section and the bottom surface of said platform respectively; and a distance between said base section and said platform can be adjusted by turning said adjusting knob to expand or contract said first and second pairs of scissor arms.

15. A portable gynecological exam device as recited in claim 13 further comprising:

first and second platform flanges, each flange having a lip;

said first platform flange is connected to said platform with said respective lip being slightly higher than said top surface of the platform at said first end;

said second platform flange is connected to said platform with said respective lip being slightly higher than the top surface of said platform at said second end;

said lips of said first and second platform flanges are connected to the back surface of said bottom section to create a space in between said back surface of said bottom section and said platform; and said first and second sliding panels are configured to be stored within said space.

16. A portable gynecological exam device as recited in claim 15 further comprising:

a plurality of support plates;

each of said support plates is connected between said first and second pairs of scissor arms; and a notch formed on said second platform flange to accommodate said long screw.

17. A portable gynecological exam device as recited in claim 1, wherein said folding panels and sliding panels are configured to be extended to accommodate patients of different sizes, weights and heights for comfort and stability.

* * * * *